US008907788B2

(12) United States Patent
Hisada

(10) Patent No.: US 8,907,788 B2
(45) Date of Patent: Dec. 9, 2014

(54) THEFT TRACKING DEVICE

(71) Applicant: Denso Corporation, Kariya, Aichi-pref. (JP)

(72) Inventor: Masaaki Hisada, Obu (JP)

(73) Assignee: Denso Corporation, Kariya (JP)

( * ) Notice: Subject to any disclaimer, the term of this patent is extended or adjusted under 35 U.S.C. 154(b) by 154 days.

(21) Appl. No.: 13/739,026

(22) Filed: Jan. 11, 2013

(65) Prior Publication Data

US 2013/0181835 A1 Jul. 18, 2013

(30) Foreign Application Priority Data

Jan. 13, 2012 (JP) ..... 2012-005160
Jan. 10, 2013 (JP) ..... 2013-002592

(51) Int. Cl.

| | |
|---|---|
| ***G08B 1/08*** | (2006.01) |
| ***G08B 13/24*** | (2006.01) |
| ***G08B 13/14*** | (2006.01) |
| ***G08B 21/02*** | (2006.01) |

(52) U.S. Cl.

CPC ..... *G08B 13/2462* (2013.01); *G08B 13/1427* (2013.01); *G08B 21/0269* (2013.01); *G08B 21/0288* (2013.01)

USPC ..... 340/539.32; 340/539.31

(58) Field of Classification Search

USPC ..... 340/539.32

See application file for complete search history.

(56) References Cited

U.S. PATENT DOCUMENTS

| | | | | |
|---|---|---|---|---|
| 3,821,998 | A * | 7/1974 | Hollins | 180/68.5 |
| 7,062,305 | B1 * | 6/2006 | Cameron et al. | 455/575.1 |
| 2004/0095093 | A1 | 5/2004 | Baba et al. | |

FOREIGN PATENT DOCUMENTS

| | | |
|---|---|---|
| CN | 1485946 | 3/2004 |
| EP | 2180544 | 4/2010 |
| JP | 11-274747 | 10/1999 |
| JP | 11-278336 | 10/1999 |
| JP | 2009-190603 | 8/2009 |
| JP | 2011-051376 | 3/2011 |
| JP | 2013-061859 | 4/2013 |

OTHER PUBLICATIONS

Office action dated Apr. 24, 2014 in corresponding Chinese Application No. 201310011768.4.
Extended Search Report issued Apr. 11, 2013 in corresponding European Application No. 1311501115.7.
Extended Search Report issued Apr. 11, 2013 in corresponding European Application No. 13150115.7.

* cited by examiner

*Primary Examiner* — Kerri McNally
(74) *Attorney, Agent, or Firm* — Harness, Dickey & Pierce, PLC

(57) ABSTRACT

A theft tracking device includes a circuit board, a battery, a battery case, a housing, and an engagement part. The circuit board specifies a current position and transmits current position information regarding the current position specified through a wireless communication. The battery case houses at least a part of the battery. The housing houses the circuit board, the battery case and the battery housed in the battery case. The engagement part is provided by the housing, and engages with the battery case such that a first space of the housing in which the circuit board is located is separated from a second space of the housing that faces the battery.

7 Claims, 10 Drawing Sheets

THEFT TRACKING DEVICE

CROSS REFERENCE TO RELATED APPLICATION

This application is based on Japanese Patent Application No. 2012-5160 filed on Jan. 13, 2012 and No. 2013-2592 filed on Jan. 10, 2013, the disclosures of which are incorporated herein by reference.

TECHNICAL FIELD

The present disclosure relates to a theft, tracking device that is equipped to an object and is used for tracking the object when the object is stolen.

BACKGROUND

Recently, it has been known to equip a theft tracking device to an object, such as a motorcycle and a navigation device, for tracking the object when the object is stolen. The theft tracking device transmits information on, a current position of the object when the object is stolen. Such a theft tracking device is, for example, described in JP2011-51376A.

The theft tracking device includes a circuit board and a back-up battery. The circuit board performs operations to specify a current position of the theft tracking device through a global positioning system (GPS), a vehicle information and communication system (VICS) or the like, and to transmit the information specified through a wireless communication. The back-up battery supplies electric power to the circuit board.

FIG. 9 illustrates a theft tracking device 100 for a motorcycle, as an example. The theft tracking device 100 includes a back-up battery (BUB) 102, a battery case 101, a circuit board 103, a housing body 110 and a housing cover 111. The battery case 101 has an opening at its bottom, and the BUB 102 is housed in the battery case 101. The battery case 101 is fixed to the circuit board 103 and is disposed in the housing body 110 in a state of being fixed to the circuit board 103.

In the theft tracking device 100, the housing body 110 has an opening for installing the components, such as the BUB 102, inside of the housing body 110. The opening of the housing body 110 is covered with the housing cover 111. In FIG. 9, the housing cover 111 is illustrated as transparent for a purpose of showing the inside of the housing body 110. Also in FIG. 10, the housing cover 111 is illustrated as transparent for the similar purpose.

In a case where a circuit board and a back-up battery are housed in the same housing body, if a battery liquid leaks from the back-up battery due to vibration of the motorcycle, the battery liquid will adhere to the circuit board.

If the battery liquid adheres to the circuit board, the circuit board may be corroded from a portion to which the battery liquid is adhered, resulting in a failure in operation of the circuit board.

To address such an issue, in the theft tracking device 100 of FIG. 9, the battery case 101 has the opening at its bottom, and the BUB 102 is received in the battery case 101 such that a bottom portion of the BUB 102 exposes from the bottom of the battery case 101. Further, the circuit board 103 is arranged above the battery case 101.

In such an arrangement, even if the battery liquid leaks from the BUB 102, the battery liquid accumulates on a bottom wall of the housing body 110. Further, even if the battery liquid accumulated jumps due to the vibration, it is less likely that the battery liquid accumulated on the bottom wall will reach the circuit board 103.

To further restrict the adhesion of the battery liquid to the circuit board 103, it is considered to cover the entirety, of the BUB 102, except for the end, with the battery case 101, as shown in FIG. 10. In this case, the end of the BUB 102 is not covered with the battery case 101 because the battery case 101 has an opening for installing the BUB 102 into the battery case 101.

Namely, the battery case 101 covers the bottom portion of the BUB 102. In such a case, however, the thickness of the housing body 110, such as a dimension in an up and down direction in FIG. 10, increases as compared with the housing body 110 in which the battery case 101 does not cover the bottom portion of the BUB 102 (e.g., FIG. 9). As a result, the overall size of the theft tracking device 100 is likely to increase.

As another example of restricting the adhesion of the battery liquid to the circuit board 103, a structure shown in FIG. 11 is considered. In the structure shown in FIG. 11, similar to a battery of a cell phone, the BUB 102 is attached to the outside of the housing body 110. Further, the battery case 101 is fixed to the housing body 110 to cover the BUB 102.

In such a case, however, the position of the BUB 102 will be easily found from the outside of the housing body 110. Therefore, the BUB 102 will be easily removed from the housing body 110 when the theft tracking device. 100 is stolen. As a result, the circuit board 103 will not perform properly.

SUMMARY

It is an object of the present disclosure to provide a theft tracking device capable of restricting adhesion of a battery liquid leaked from a battery to a circuit board.

According to an aspect of the present disclosure, a theft tracking device includes a circuit board, a battery, a battery case, a housing, and an engagement part. The circuit board specifies a current position and transmits current position information regarding the current position specified through a wireless communication. The battery supplies electric power to the circuit board. The battery case houses at least a part of the battery. The housing houses the circuit board, the battery case and the battery housed in the battery case. The engagement part is provided by the housing. The engagement part engages with the battery case such that a first space of the housing in which the circuit board is located is separated from a second space of the housing that faces the battery.

In the theft tracking device according to the above aspect, the first space and the second space of the housing are separated from each other by the engagement part. Therefore, even if a battery liquid leaks out from the battery in the housing, the battery liquid will stay only in the second space. Namely, it is less likely that the battery liquid will enter the first space in which the circuit board is located. Accordingly, although the battery is housed in the housing together with the circuit board, it is less likely that the battery liquid will adhere to the circuit board. Also, the size of the housing will not increase.

BRIEF DESCRIPTION OF THE DRAWINGS

The above and other objects, features and advantages of the present disclosure will become more apparent from the following detailed description made with reference to the accompanying drawings, in which like parts are designated by like reference numerals and in which.

DETAILED DESCRIPTION

Exemplary embodiments of the present disclosure will be hereinafter described with reference to the drawings illustrated in a third angle projection.

First Embodiment

A theft tracking device 1 according to the first embodiment will be described with reference to FIGS. 1A to 4B.

Figure 4A:
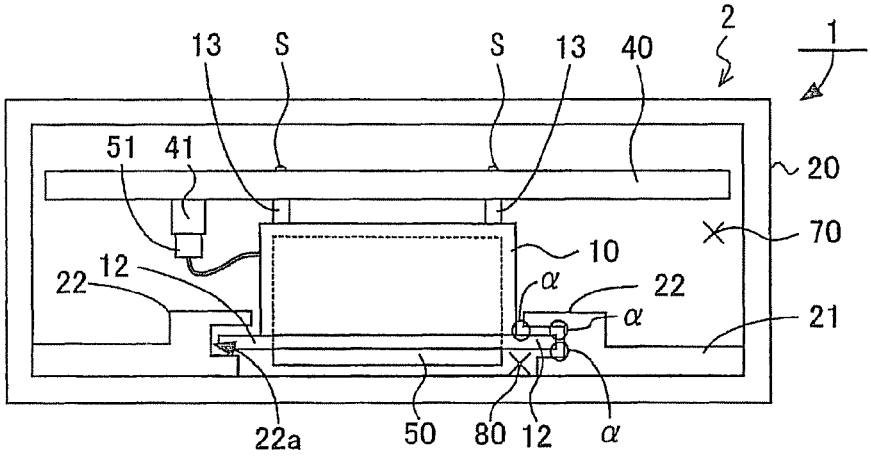
FIG. 4A is a front view of the housing body in which the battery case, a battery, and a circuit board are disposed, according to the first embodiment.
Figure 4B:
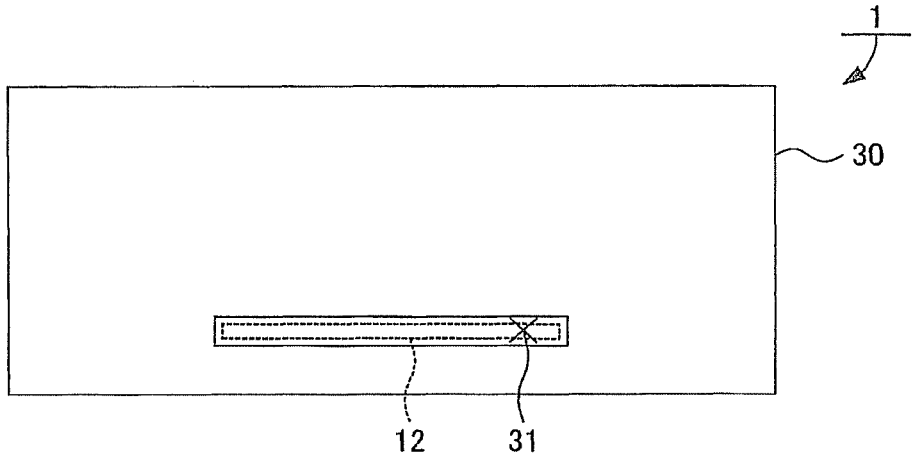
FIG. 4B is a back view of the housing cover according to the first embodiment.

Referring to FIGS. 4A and 4B, the theft tracking device 1 includes a circuit board 40 for performing communication, a back-up battery (hereinafter BUB) 50, a battery case 10 and a housing 2. The housing 2 includes a housing body 20 and a housing cover 30.

The circuit board 40 performs operations to specify a current position of the theft tracking device 1 and to transmit current position information regarding the current position specified through a wireless communication. The BUB 50 supplies electric power to the circuit board 40. The BUB 50 is received in the battery case 10 in such a manner that a part of the BUB 50 is exposed from the battery case 10. The circuit board 40 and the battery case 10 in which the BUB 50 is received are disposed in the housing body 20.

A structure of each of these components will be described.

Referring to FIGS. 1A to 1D, the battery case 10 includes a case body 11 having a rectangular parallelepiped shape with an opening 11*a* at its bottom. A part of the BUB 50 is received in an accommodation space 11*b* defined in the case body 11 through the opening 11*a*.

The case body 11 includes a top wall 11*d*, and side walls 11*c* extending from the top wall 11*d*. A flange 12 extends from the lower ends of the side walls 11*c*. The flange 12 is continuous along the lower ends of the side walls 11*c*, on a periphery of the side walls 11*c*. Thus, the flange 12 has a rectangular flange shape when viewed from the top of the case body 11. A lower surface of the flange 12 is coplanar with lower surfaces of the lower ends of the side walls 11*c*. Namely, the flange 12 is coplanar with the lower end of the case body 11.

The case body 11 has four screw-receiving portions 13 adjacent to four corners of the top wall 11*d*. The screw-receiving portions 13 extend from the top wall 11*d* opposite to the side walls 11*c*. Each of the screw-receiving portion 13 is formed with a threaded hole therein along a center axis of the screw-receiving portion 13. The battery case 10 is fixed to the circuit board 40 through the screw-receiving portions 13.

Figure 1A:
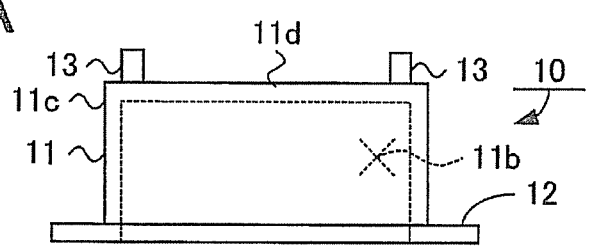
FIG. 1A is a front view of a battery case of a theft tracking device according to a first embodiment of the present disclosure.
Figure 1B:
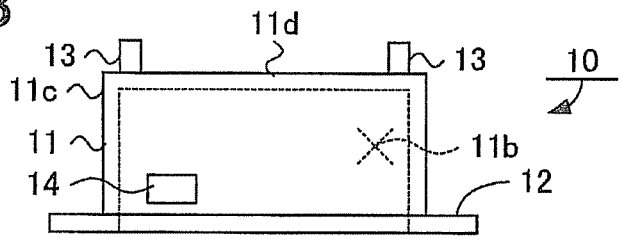
FIG. 1B is a side view of the battery case according to the first embodiment.
Figure 1C:
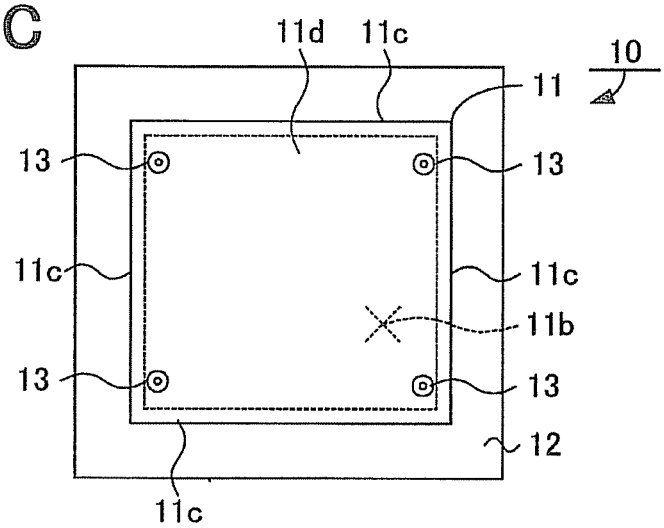
FIG. 1C is a top view of the battery case according to the first embodiment.
Figure 1D:
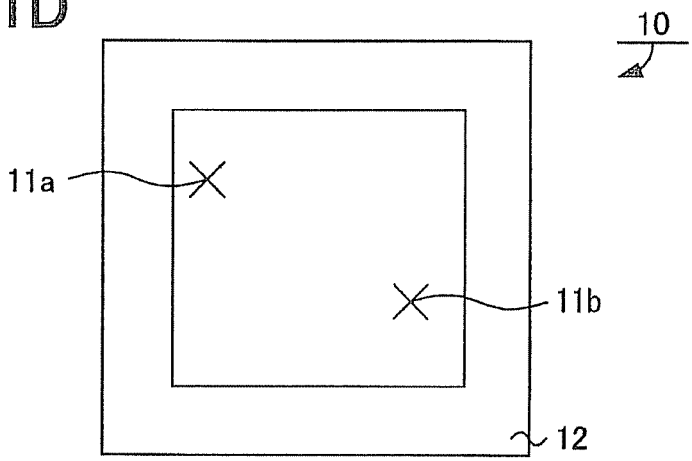
FIG. 1D is a bottom view of the battery case according to the first embodiment.

The circuit board 40 receives the electric power from the BUB 50 through an electric power line. As shown in FIG. 1B, one of the side walls 11*c*, which corresponds to a right side wall 11*c* in FIG. 4A, is formed with a through hole 14 to allow the electric power line to extend from the BUB 50 to the circuit board 40. The through hole 14 has a size that allows a connector 51 fixed at an end of the electric power line to pass through the through hole 14.

Figure 2A:
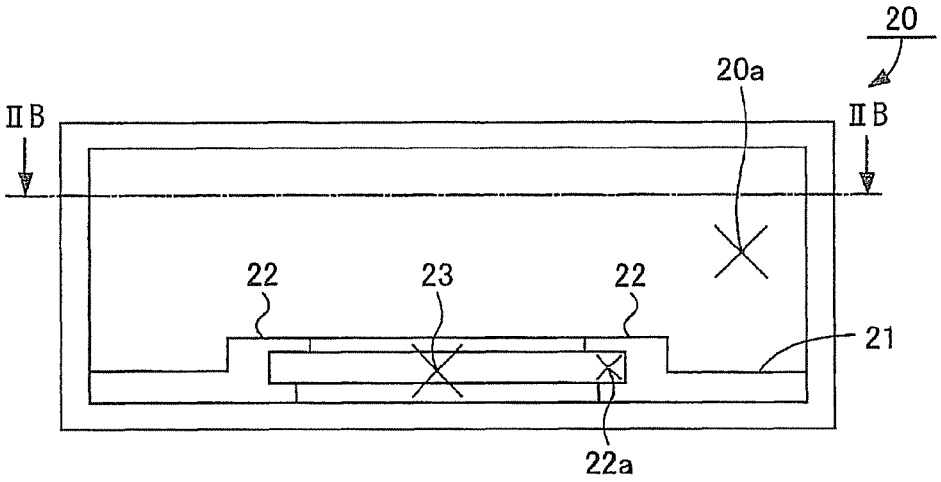
FIG. 2A is a front view of a housing body of the theft tracking device according to the first embodiment.
Figure 2B:
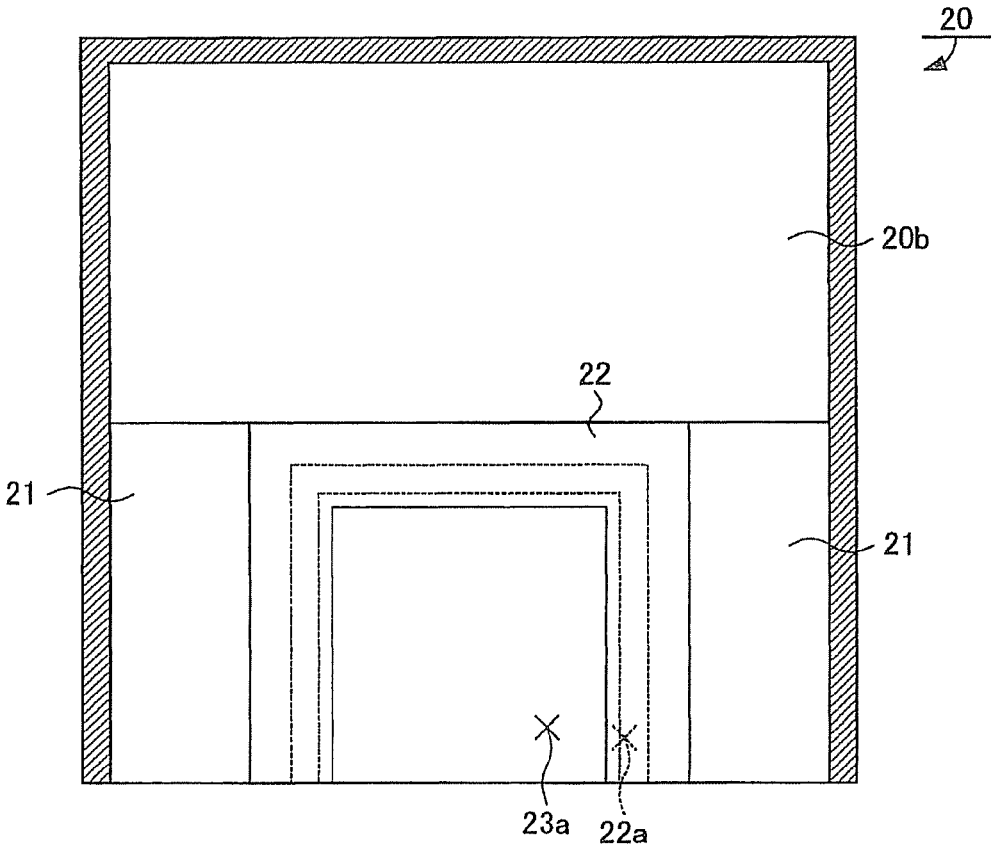
FIG. 2B is a cross-sectional view of the housing body taken along a line IIB-IIB in FIG. 2A.

The housing body 20 has a substantially rectangular parallelepiped shape with an opening 20*a* at one side, such as at a front side in FIG. 2A. As shown in FIG. 2B, the housing body 20 has a fixing portion 21 for fixing the battery case 10 at an end portion of an inner bottom surface 20*b* adjacent to the opening 20*a*. Hereinafter, the side where the opening 20*a* of the housing body 20 is formed, such as a lower side in FIG.

2B, is referred to as a front side, and a side opposite to the opening 20*a*, such as an upper side of FIGS. 2B and 4A, is referred to as a back side.

The fixing portion 21 is higher than the inner bottom surface 20*b* of the housing body 20. Further, a raised portion 22 is formed at a middle of the fixing portion 21 with respect to a longitudinal direction of the opening 20*a*, such as a left and right direction of FIG. 2A. The raised portion 22 is higher than the fixing portion 21 located at opposite sides of the raised portion 22. An engagement recess 23 is formed at a middle of the raised portion 22. The engagement recess 23 is depressed from a top surface of the raised portion 22. When viewed from the top, the raised portion 22 has a substantially U-shape that defines an opening on the same plane as the opening 20*a* of the housing body 20.

The engagement recess 23 is formed with a predetermined size to engage with the case body 11. The raised portion 22 has a groove 22*a* on its inner surface defining the engagement recess 23. The groove 22*a* receives the flange 12 when the case body 11 is inserted in the engagement recess 23. The groove 22*a* is formed along the inner surface of the raised portion 22. The groove 22*a* has a substantially U-shape in a cross-section defined in the up and down direction of FIG. 2A.

Figure 3A:
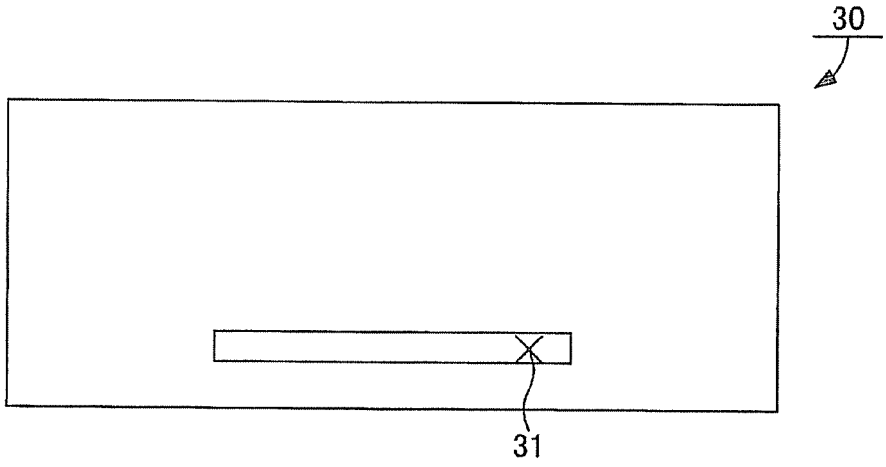
FIG. 3A is a back view of a housing cover of the theft tracking device according to the first embodiment.
Figure 3B:
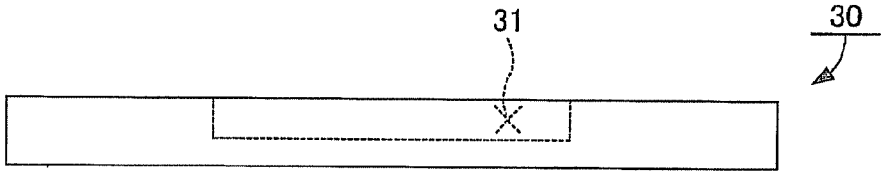
FIG. 3B is an end view of the housing cover according to the first embodiment.

The housing 2 includes the housing cover 30 that covers the opening 20*a* of the housing body 20. As shown in FIGS. 3A and 3B, the housing cover 30 has substantially a plate shape with a size that can cover the opening 20*a* of the housing body 20.

The housing cover 30 is formed with an reception hole 31 on its inner surface to receive the flange 12 of the battery case 10. When the case body 11 is arranged in the engagement recess 23 such that the flange 12 is engaged with the groove 22*a*, a front portion of the flange 12 projects from the opening 20*a* of the housing body 20*a*.

When the housing cover 30 is coupled to the housing body 20 to cover the opening 20*a*, the front portion of the flange 12 projecting from the opening 20*a* is received in the reception hole 31.

Next, the circuit board 40 will be described.

The circuit board 40 has electronic circuits therein. The circuit board 40 has substantially a rectangular plate shape. The circuit board 40 has CPU, ROM, RAM and other electronic components mounted thereon. In addition to such electronic components, the circuit board 40 has a receiving element associated with the GPS for acquiring a current position, and a transmission element that transmits the current position information regarding the current information acquired by the GPS through a wireless communication.

Also, the circuit board 40 has a connecting member 41 to connect to the connector 51 of the electric power line.

The BUB 50 has a substantially rectangular parallelepiped shape, and the part of the BUB 50 is received in the accommodation space 11*b* of the battery case 10.

<Installation of BUB and Circuit Board>

Next, a method of installing the BUB 50 and the circuit board 40 in the housing body 20 will be described.

First, the battery case 10 is disposed on the circuit board 40 through the screw-receiving portions 13. Then, four screws S are attached to pass through the circuit board 40 from a rear surface to a front surface, and threaded into the screw-receiving portions 13. Thus, the battery case 10 is fixed to the circuit board 40.

Next, the BUB 50 is arranged in the accommodation space 11*b*. In this case, before the BUB 50 is inserted into the accommodation space 11*b*, the connector 51 and the electric power line are pulled out to the outside of the battery case 10 from the accommodation space 11*b* through the through hole 14.

Further, the BUB 50 is inserted into the battery case 10 such that a portion of the BUB 50 is projected outside of the battery case 10 from the opening 11*a* defined at the bottom of the battery case 10. Then, the connector 51 is connected to the connecting member 41. Further, the through hole 14 is sealed with a sealing material or in any other way.

Next, the battery case 10, which has been fixed to the circuit board 40, is positioned relative to the opening 20*a* of the housing body 20 such that the flange 12 matches with the groove 22*a*. Then, the battery case 10 is inserted into the housing body 20.

In this case, the battery case 10 is moved into the housing body 20 in a state where the flange 12 is engaged with the groove 22*a*, until a back portion of the flange 12 is received in a back portion of the groove 22*a* on the back side of FIG. 4A. As the groove 22*a* serves as a rail, the flange 12 is guided along the groove 22*a*. The battery case 10 housing the BUB 50 and the circuit board 40 are inserted into the housing body 20 while being guided by the groove 22*a*.

Then, the housing cover 30 is attached to the housing body 20 to cover the opening 20*a*. In this case, the housing cover 30 is attached to the opening 20*a* of the housing body 20 such that the front portion of the flange 12 is received in the reception hole 31 of the housing cover 30.

Further, the housing cover 30 is fixed to the housing body 20. For example, the housing cover 30 may be fixed to the housing body 20 by hook or nail portions, or may be fixed by specific screws, which can be screwed only using a specific tool. However, the method of fixing the housing cover 30 to the housing body 20 is not limited to these examples.

Advantageous Effects of the Theft Tracking Device of the First Embodiment

When the BUB 50 housed in the battery case 10 and the circuit board 40 are disposed in the housing body 20 in a manner described above, the flange 12 engages with the groove 22*a* and the reception hole 31, as shown in FIGS. 4A and 4B. The engagement between the flange 12 and the groove 22*a* and reception hole 31 forms a labyrinthine structure having at least three bent corners, as denoted by section a in FIG. 4A. As such, a first space 70 in which the circuit board 40 is located and a second space 80 facing the BUB 50 are separated from each other.

Therefore, even if a battery liquid leaks out the BUB 50, it is less likely that the battery liquid will enter the first space 70 from the second space 80. As such, in the theft tracking device 1, although the BUB 50 that is partly exposed from the battery case 10 is disposed in the housing body 20 together with the circuit board 40, it is less likely that the battery liquid leaked from the BUB 50 will adhere to the circuit board 40.

Further, the first space 70 and the second space 80 are separated from each other by engaging the flange 12 with the groove 22*a* and the reception hole 31. Namely, the first space 70 and the second space 80 are separated from each other by a relatively simple structure.

When the BUB 50 received in the battery case 10 and the circuit board 40 are inserted into the housing body 20, the groove 22*a* of the raised portion 22 serves as the guide rail. Namely, the BUB 50 received in the battery case 10 and the circuit board 40 are, inserted into the housing body 20 from the opening 20*a* while the flange 12 is being engaged with the groove 22*a*, and then the housing cover 30 is fixed to the housing body 20 to cover the opening 20*a*. In this way, the BUB 50 received in the battery case 10 and the circuit board 40 are easily disposed in the housing 2.

Also, the battery case 10 is fixed to the circuit board 40 through the screw-receiving portions 13, and thus a space is provided between the battery case 10 and the circuit board 40. In this case, the space is effectively used as an arrangement space of the electronic elements mounted on the circuit board 40.

Second Embodiment

A second embodiment will be hereinafter described with reference to FIGS. 5A to 5C. Parts similar to the first embodiment will be designated with the same reference numerals.

In the theft tracking device 1 of the second embodiment, the housing 2 has a shape different from that of the theft tracking device 1 of the first embodiment.

Figure 5A:
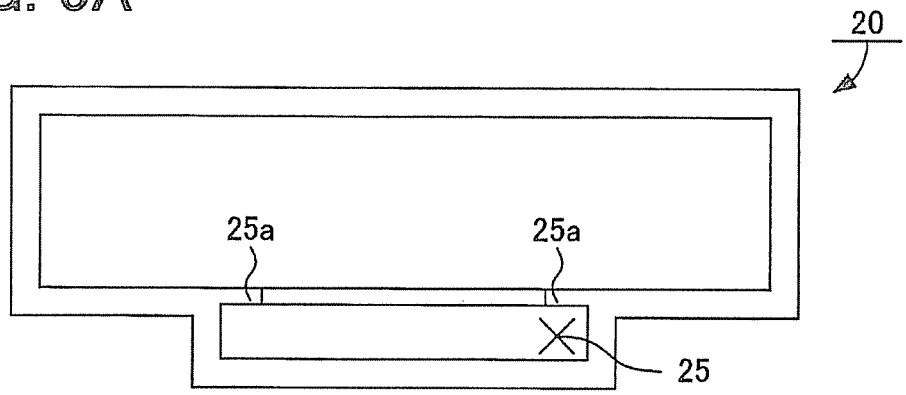
FIG. 5A is a front view of a housing body of a theft tracking device according to a second embodiment of the present disclosure.

In particular, as shown in FIG. 5A, the housing body 20 does not have the fixing portion 21 and the raised portion 22. Instead, a portion for receiving the BUB 50 is protruded from the bottom of the housing body 20. Namely, the housing body 20 has a protruded portion at the bottom. The protruded portion of the housing body 20 forms an accommodation space 25 with a depth that is capable of receiving a lower part of the battery case 10 including the flange 12. The housing body 20 has a projection 25*a* on the perimeter of the accommodation space 25 to engage with the flange 12. The flange 12 is hooked or engaged with the projection 25*a*. The projection 25*a* restricts the battery case 10 (BUB 50) from moving out from the accommodation space 25.

Figure 5B:
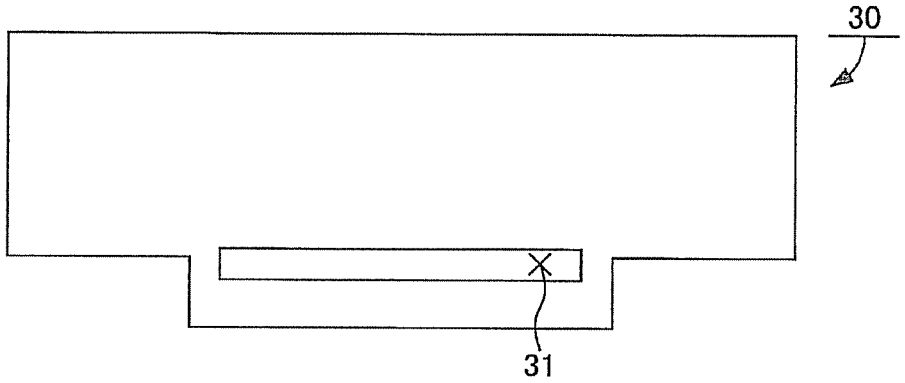
FIG. 5B is a back view of a housing cover of the theft tracking device according to the second embodiment.

As shown in FIG. 5B, the housing cover 30 has a shape corresponding to the shape of the housing body 20. For example, the housing cover 30 has substantially a T-shape. The housing cover 30 is formed with the reception hole 31. When the lower part of the battery case 10 including the flange 12 is received in the accommodation space 25, the front portion of the flange 12 projects from the opening 20*a* of the housing body 20. The front portion of the flange 12 is received in the reception hole 31.

Figure 5C:
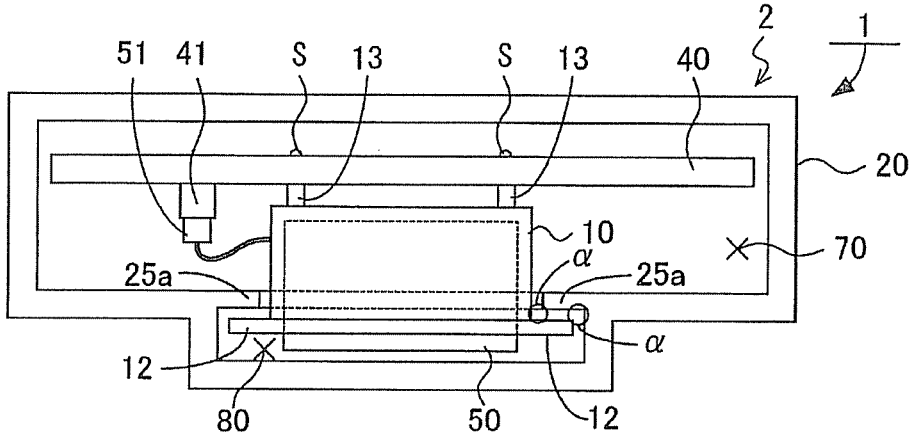
FIG. 5C is a front view of the housing body in which a battery, a battery case, and a circuit board are disposed, according to the second embodiment.

Also in the theft tracking device 1 of the second embodiment, the engagement between the flange 12 and the projection 25*a* and reception hole 31 forms a labyrinthine structure including at least two bent corners as denoted by section a in FIG. 5C. Therefore, the first space 70 in which the circuit board 40 is located and the second space 80 that is provided by the accommodation space 25 and faces the BUB 50 are separated from each other.

Therefore, even if the battery liquid leaks out from the BUB 50, it is less likely that the battery liquid will enter the first space 70. As such, even if the BUB 50, which is partly exposed from the battery case 10, is housed in the housing body 20 together with the circuit board 40, it is less likely that the battery liquid, leaked from the BUB 50 will adhere to the circuit board 40.

In the second embodiment, the BUB 50 received in the battery case 10 and the circuit board 40 are easily inserted into the housing body 20 in a state where the flange 12 is engaged or hooked with the projection 25*a*. Further the first space 70 and the second space 80 are separated from each other by the engagement between the flange 12 and the projection 25*a* and reception hole 31. Namely, the first space 70 and the second space 80 are separated from each other with a relatively simple structure.

Third Embodiment

A third embodiment will be described with reference to FIGS. 6A to 6D. Parts similar to the first embodiment will be designated with like reference numerals.

In the theft tracking device 1 of the third embodiment, the housing body 20 has a shape different from that of the first embodiment.

Figure 6A:
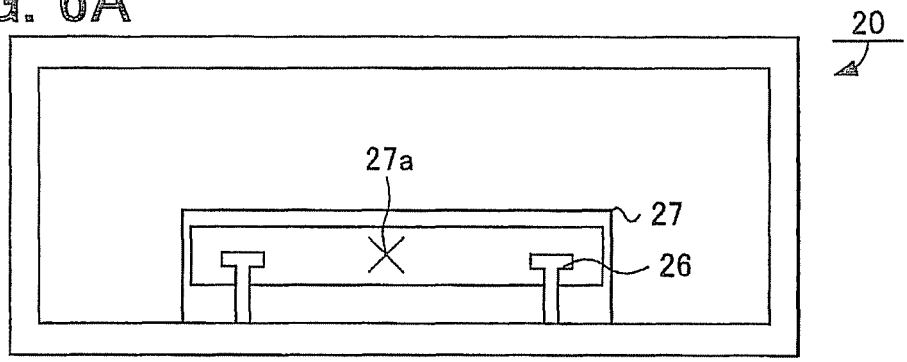
FIG. 6A is a front view of a housing body of a theft tracking device according to a third embodiment of the present disclosure.

In particular, as shown in FIG. 6A, the housing body 20 does not have the fixing portion 21 and the raised portion 22. Instead, the housing body 20 has rail portions 26 projecting from an inner bottom surface of the housing body 20. The rail portions 26 extends from a front end of the housing body 20 defining the opening 20*a* toward a back end of the housing body 20 in the shape of rail. Each of the rail portions 26 has a substantially T-shape in a cross-section defined along the up and down direction. Further, the housing body 20 has a back wall 27 at the back ends of the rail portions 26. The back wall 27 is formed with an engagement hole 27*a* to engage with the back portion of the flange 12 of the battery case 10.

Figure 6B:
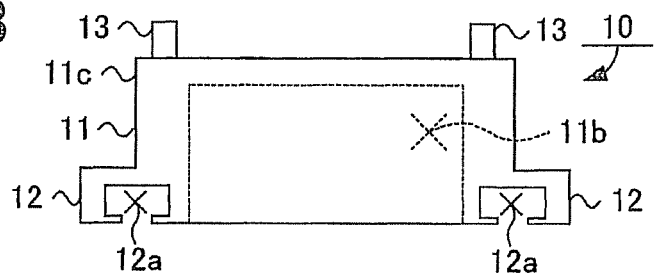
FIG. 6B is a front view of a battery case of the theft tracking device according to the third embodiment.

As shown in FIG. 6B, the battery case 10 has a shape different from that of the first embodiment. The flange 12 has a dimension (thickness) greater than that of the flange 12 of the first embodiment.

Figure 6C:
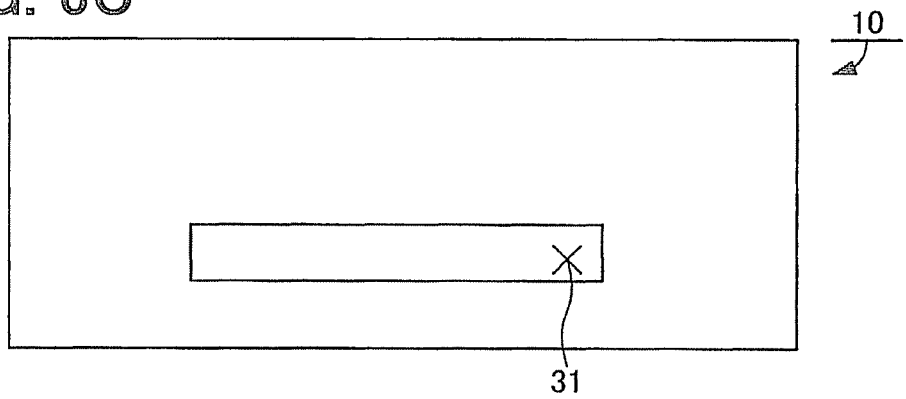
FIG. 6C is a back view of a housing cover of the theft tracking device according to the third embodiment.

The flange 12 has a rail opening 12*a* therein. For example, the flange 12 has substantially a C-shape in a cross-section defined in the up and down direction. Namely, when the rail portion 26 is received in the rail opening 12*a*, the flange 12 surrounds the upper side of the T-shaped rail portion 26. Further, the size (e.g., height) of the reception hole 31 of the housing cover 30 is greater than that of the reception hole 31 of the first embodiment, according to the thickness of the flange 12, as shown in FIG. 6C.

Figure 6D:
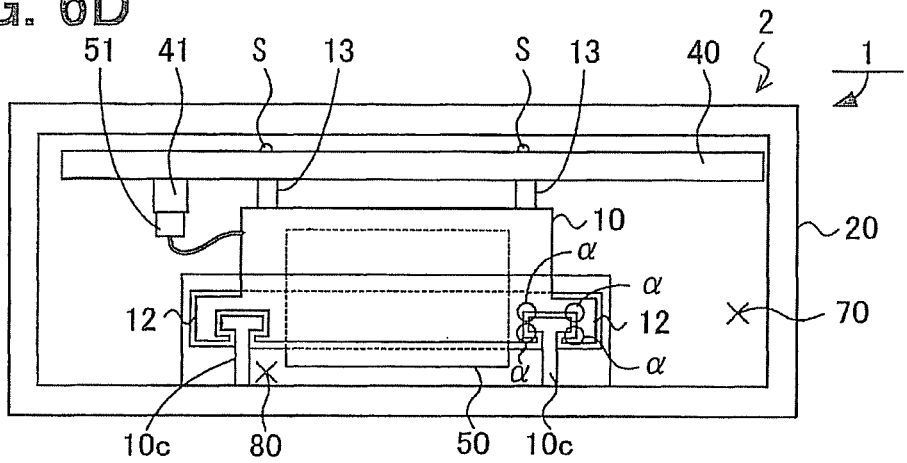
FIG. 6D is a front view of the housing body in which the battery case, a battery and a circuit board are disposed, according to the third embodiment.

In the theft tracking device 1 of the third embodiment, as shown in FIG. 6D, the BUB 50 received in the battery case 10 and the circuit board 40 are inserted into the housing body 20 from the opening 20*a* toward the back end of the housing body 20 in such a manner that the rail portions 26 are received in the rail openings 12*a*. In this case, the battery case 10 is inserted into the housing body 20 while being guided by the rail portions 26, until the back portion of the flange 12 is engaged with the engagement hole 27*a* of the back wall 27.

Similar to the first embodiment, the front portion of the flange 12 projects outside of the housing body 20 from the opening 20*a*. Therefore, the housing cover 30 is fixed to the housing body 20 such that the front portion of the flange 12 is received in the reception hole 31 of the housing cover 30.

In this case, the battery case 10 and the housing body 20 are engaged with each other at the back portion of the flange 12 received in the engagement hole 27*a* and side portions of the flange 12 received in the rail openings 12*a*. Also, the battery case 10 and the housing body 20 are engaged with each other at the front portion of the flange 12 and the reception hole 31 of the housing 30. Accordingly, the engagement between the battery case 10 and the housing body 20 forms a labyrinthine structure including four bent corners, as denoted by sections a in FIG. 6D.

Therefore, the second space 80 is surrounded by the rail portions 26, the back wall 27 and the housing cover 30. The second space 80 facing the bottom portion of the BUB 50 exposed from the battery case 10 is separated from the first space 70 in which the circuit board 40 is located. As such, even if the battery liquid leaks out from the BUB 50, it is less likely that the battery liquid will enter the first space 70.

In the third embodiment, even if the BUB 50 partly exposed from the battery case 10 is disposed in the housing body 20 together with the circuit board 40, it is less likely that the battery liquid leaked from the BUB 50 will adhere to the circuit board 40.

Further, the first space 70 and the second space 80 are separated from each other by inserting the battery case 10 into the housing body 20 such that the flange 12 engages with the rail portions 26, the engagement hole 27*a* and the reception hole 31. Namely, the first space 70 and the second space 80 are separated from each other by a simple structure.

Fourth Embodiment

A fourth embodiment will be described with reference to FIGS. 7A to 7C and 8A to 8D Parts similar to the first embodiment will be designated with like reference numerals. In the theft tracking device 1 of the fourth embodiment, the housing 2 has a shape different from that of the first embodiment.

Figure 7A:
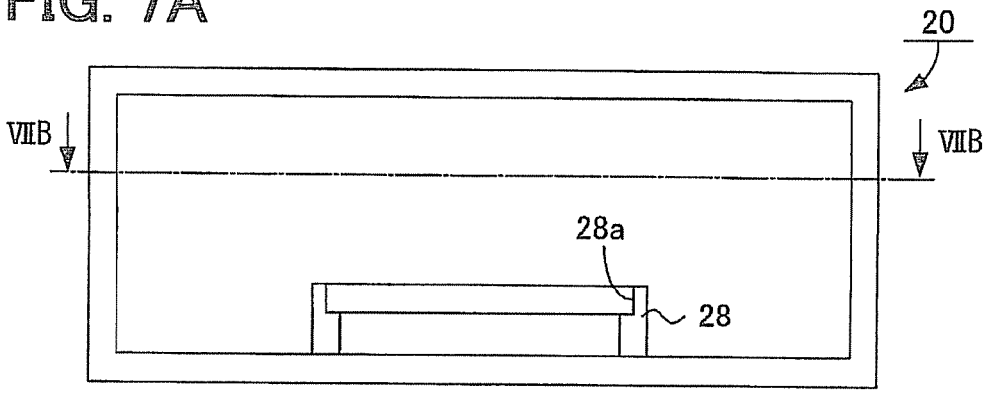
FIG. 7A is a front view of a housing body of a theft tracking device according to the fourth embodiment.
Figure 7B:
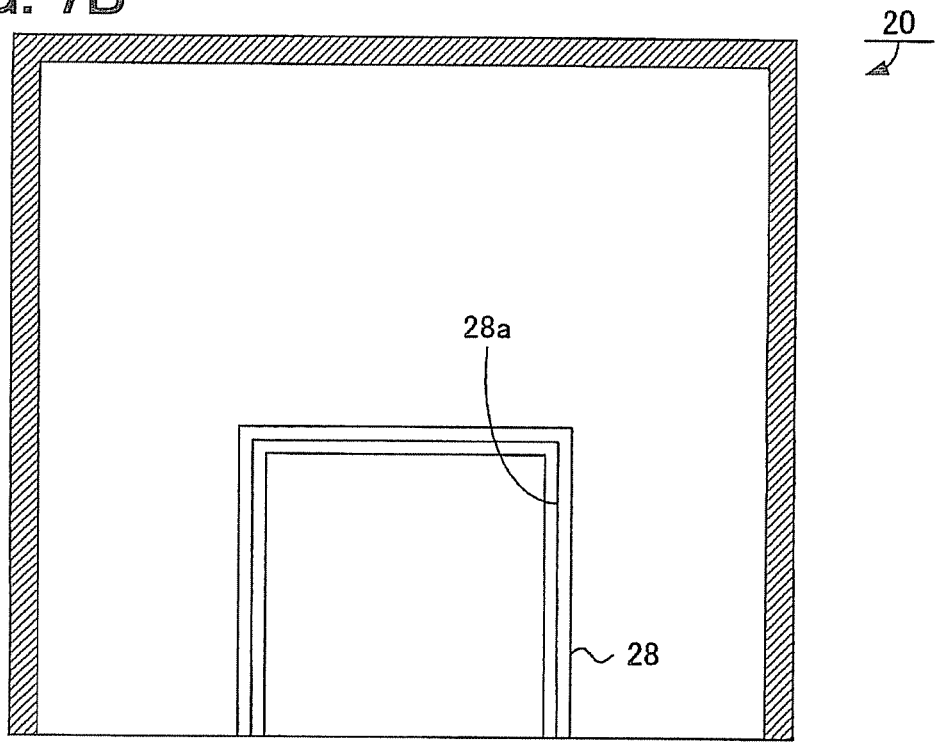
FIG. 7B is a cross-sectional view of the housing body taken along a line VIIB-VIIB in FIG. 7A.

In particular, as shown in FIGS. 7A and 7B, the housing body 20 does not have the fixing portion 21 and the raised portion 22. Instead, the housing body 20 has a rising portion 28 with a substantially U-shape on an inner bottom surface. The rising portion 28 has a step portion 28*a* on its inner surface.

Figure 7C:
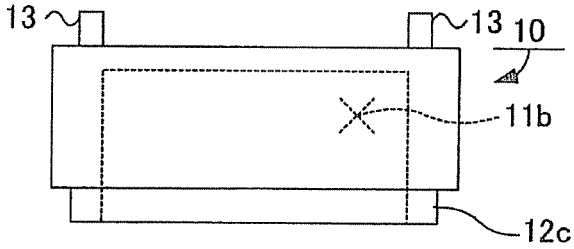
FIG. 7C is a front view of a battery case of the theft tracking device according to the fourth embodiment.

As shown in FIG. 7C, the battery case 10 has a shape different from the first embodiment. In the fourth embodiment, the battery case 10 does not have the flange 12. Instead, the battery case 10 has a step portion 12*c* on an outer surface of the bottom end portion that defines the opening 11*a* for receiving the BUB 50. The step portion 12*c* is formed to engage with the step portion 28*a* of the rising portion 28.

Figure 8A:
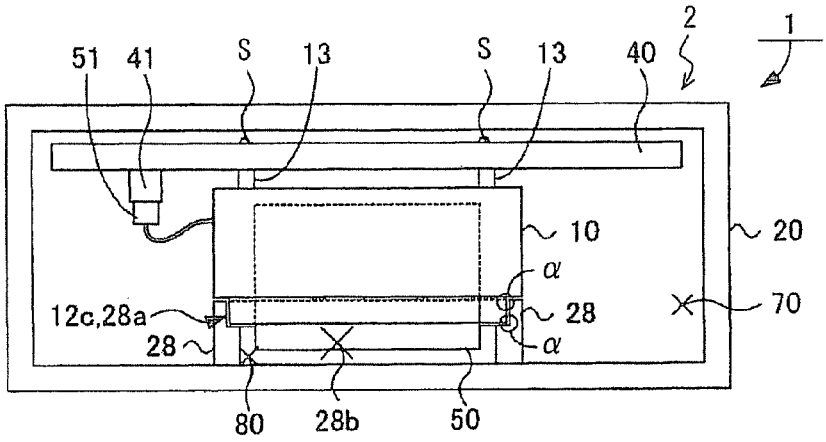
FIG. 8A is a front view of the housing body in which the battery case, a battery, and a circuit board are disposed, according to the fourth embodiment.

As shown in FIG. 8A, when the battery case 10 is inserted in the housing body 20 such that the step portion 12*c* is engaged with the step portion 28*a* of the rising portion 28, the engagement between the step portion 28*a* and the step portion 12*c* forms a labyrinthine structure including at least two bent corners as denoted by sections a.

Figure 8B:
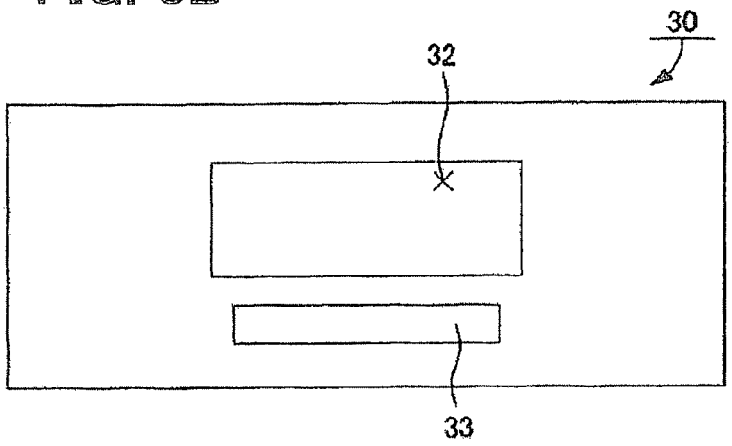
FIG. 8B is a back view of a housing cover of the theft tracking device according to the fourth embodiment.
Figure 8D:
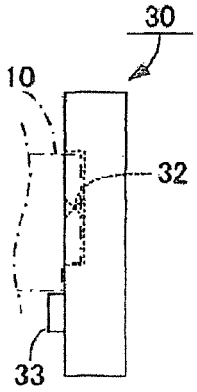
FIG. 8D is a side view of the housing cover according to the fourth embodiment.
Figure 8C:
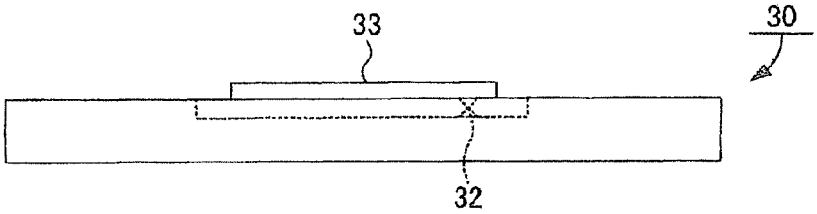
FIG. 8C is an end view of the housing cover according to the fourth embodiment.
Figure 9:
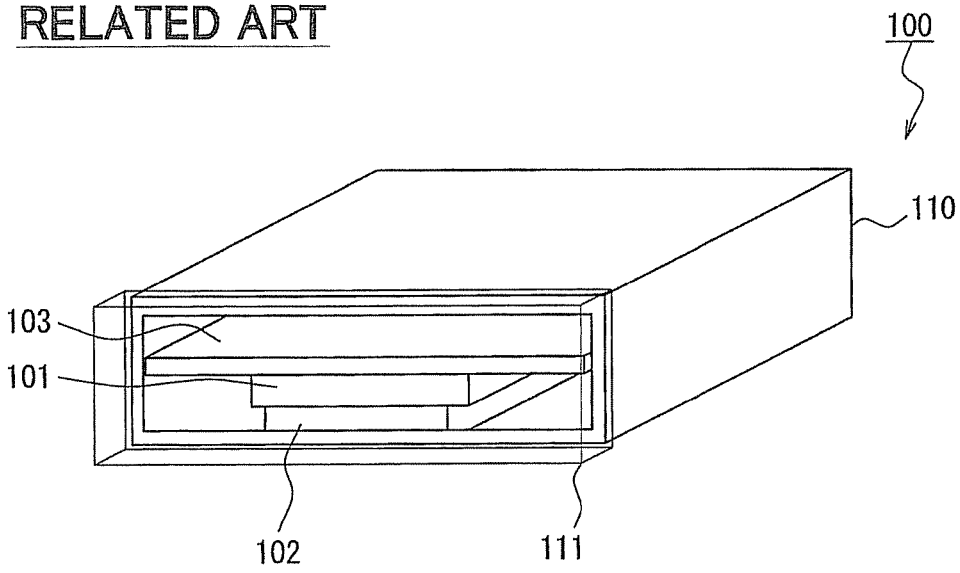
FIG. 9 RELATED ART
FIG. 9 is a perspective view of a theft tracking device as a related art.
Figure 10:
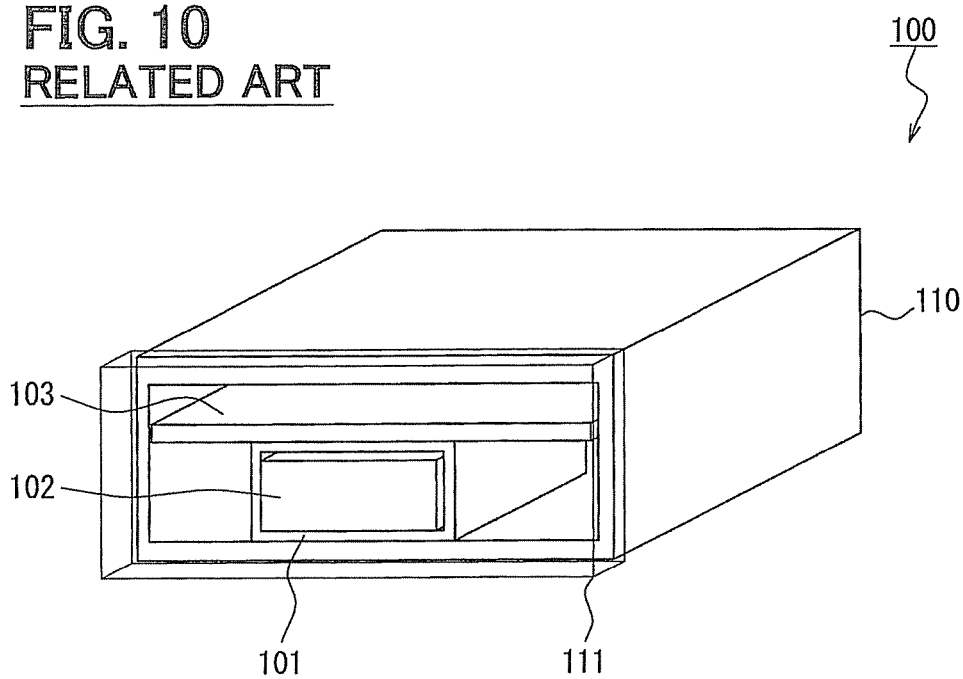
FIG. 10 RELATED ART
FIG. 10 is a perspective view of a theft tracking device as a related art.
Figure 11:
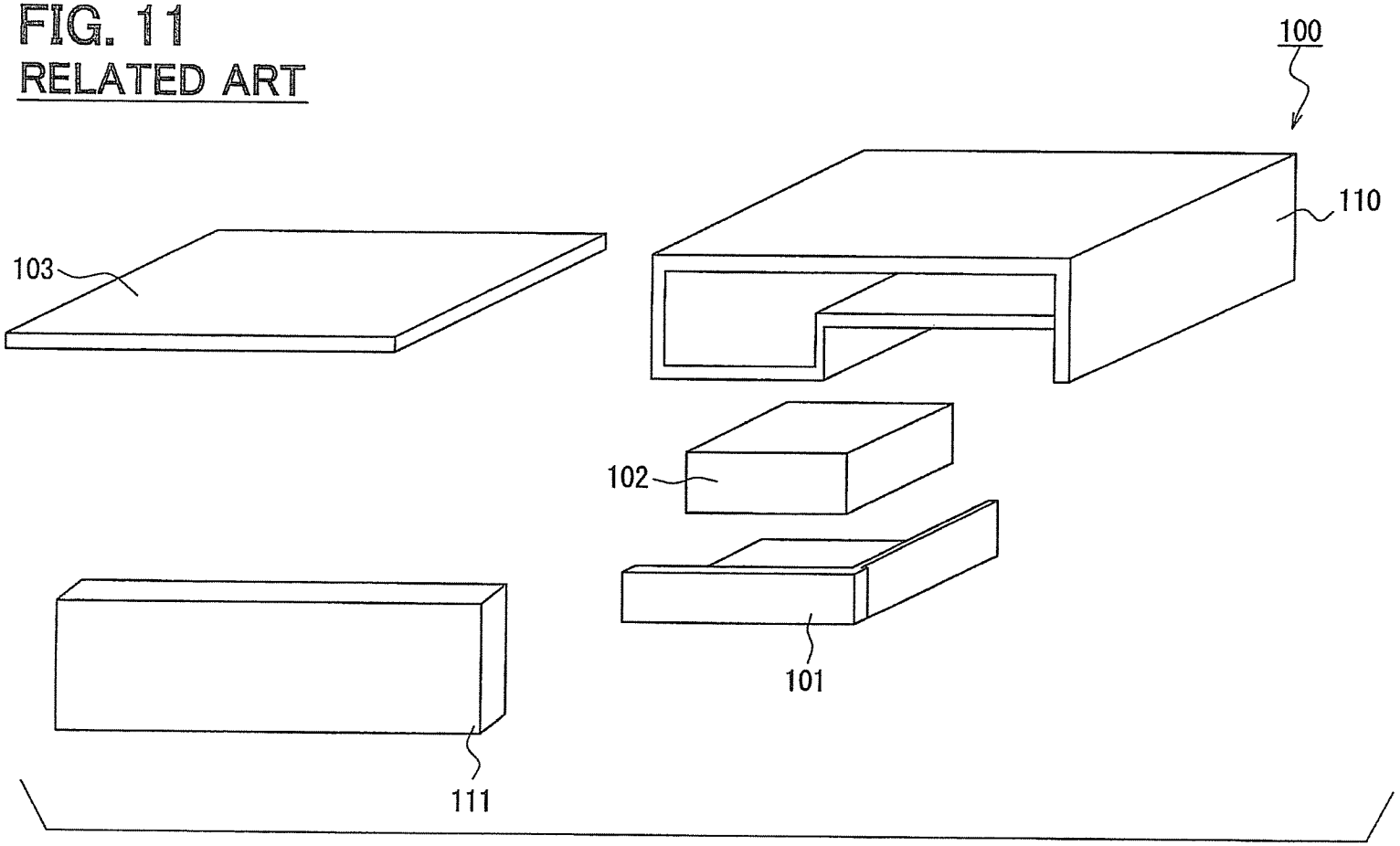
FIG. 11 RELATED ART
FIG. 11 is a perspective view of a theft tracking device as a related art.

As shown in FIGS. 8B to 8D, the housing cover 30 has an engagement hole 32 to receive a front part of the battery case 10 projecting from the front end of the housing body 20. Also, the housing cover 30 has a projection 33 to be received in a space 28*b* defined between the battery case 10, the rising portion 28 and the inner bottom surface of the housing body 20.

When the housing cover 30 is coupled to the housing body 20 in which the battery case 10 has been disposed, the battery case 10 is engaged with the engagement hole 32, and the projection 33 of the housing cover 30 is received in the space 28*b*. In this way, the housing cover 30 and the battery case 10 engage with each other, and the engagement between the housing cover 30 and the battery case 10 form the labyrinthine structure.

The second space 80 facing the bottom end of the BUB 50 exposed from the battery case 10 is surrounded by the rising portion 28 and the housing cover 30. The second space 80 is separated from the first space 70 in which the circuit board 40 is located.

Therefore, even if the battery liquid leaks out from the BUB 50, it is less likely that the battery liquid will enter the first space 70. Accordingly, even if the BUB 50, which is partly exposed from the battery case 10, is disposed in the housing body 20 together with the circuit board 40, it is less likely that the battery liquid leaked from the BUB 50 will adhere to the circuit board 40.

Further, the first space 70 and the second space 80 are separated from each other by coupling the battery case 10 to the rising portion 28 such that the step portion 12*c* of the battery case 10 is engaged with the step portion 28*a* of the rising portion 28 and by coupling the housing cover 30 to the housing body 20. Namely, the first space 70 and the second space 80 are separated from each other by a relatively simple structure.

<Correspondence>

In the embodiments described above, an engagement part is provided by the housing 2. When the engagement part of the housing 2 engages with an engagement portion of the battery case 10, the first space 70 in which the circuit board 40 is located and the second space 80 facing the portion of the BUB 50 are separated from each other. In the first embodiment, the engagement part is provided by the raised portion 22 having the groove 22*a* and the housing cover 30. In the second embodiment, the engagement part is provided by the projection 25*a* of the housing body 20, and the housing cover 30 having the reception hole 31. In the third embodiment, the engagement part is provided by the rail portions 26 of the housing body 20, the housing cover 30 having the reception hole 3, and the back wall 27 having the engagement hole 27*a*. In the fourth embodiment, the engagement part is provided by the rising portion 28 and the housing cover 30. Also, the groove 22*a* of the first embodiment corresponds to an engagement groove. Further, the engagement portion of the battery case 10 engaged with the engagement part of the housing 2 is provided by the flange 12 and the step portion 12*c*. In the first and third embodiment, the raised portion 22 having the groove 22*a* and the rail portion 26 provides a rail-shaped portion that guides the battery case 10 into, the housing body 20 when the battery case 10 is inserted into the housing body 20.

Other Embodiments

In the embodiments described above, the circuit board 40 acquires the current position information regarding the current position through the GPS, for example. However, the circuit board 40 may receive the information regarding the current position through any other way, such as VICS.

In the embodiments described above, the circuit board 40 is exemplarily fixed to the battery case 10 using the screws S. However, the circuit board 40 may be fixed in the housing body 20 in any other way. For example, the housing body 20 may have a rail and the circuit board 40 may be received in the housing body 20 along the rail. In this case, the circuit board 40 may not be fixed to the battery case 10 using screws S, and separate from the battery case 10.

While only the selected exemplary embodiments have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiments according to the present disclosure is provided for illustration only, and not for the purpose of limiting the disclosure as defined by the appended claims and their equivalents.

What is claimed is:

1. A theft tracking device comprising:

a circuit board that specifies a current position and transmits current position information regarding the current position specified through a wireless communication;

a battery that supplies electric power to the circuit board;

a battery case that houses at least a part of the battery;

a housing that houses the circuit board, the battery case and the battery housed in the battery case; and an engagement part that is provided by the housing, wherein the engagement part engages with an engagement portion of the battery case, and separates a first space of the housing in which the circuit board is located from a second space of the housing that faces the battery housed in the battery case; wherein the battery case has a case body defining an opening at an end and a flange projecting from the end of the case body, the engagement portion of the battery case is provided by the flange, and the engagement part defines an engagement groove to receive the flange.

2. The theft tracking device according to claim 1, wherein the battery case defines an opening, and the battery is partly exposed from the opening into the second space.

3. The theft tracking device according to claim 1, wherein the engagement part and the engagement portion of the battery case provide a labyrinthine structure that restricts a battery liquid leaked from the battery from entering the first space from the second space.

4. The theft tracking device according to claim 1, wherein the housing includes a housing body and a housing cover, the housing body defines an opening at a side for installing the battery case, the battery and the circuit board into the housing body, and, the housing cover covers the opening of the housing body.

5. The theft tracking device according to claim 1, wherein the battery case is fixed to the circuit board, and a space is provided between the battery case and the circuit board.

6. A theft tracking device comprising:

a circuit board that specifies a current position and transmits current position information regarding the current position specified through a wireless communication;

a battery that supplies electric power to the circuit board;

a battery case that houses at least a part of the battery;

a housing that houses the circuit board, the battery case and the battery housed in the battery case; and an engagement part that is provided by the housing, wherein the engagement part engages with an engagement portion of the battery case, and separates a first space of the housing in which the circuit board is located from a second space of the housing that faces the battery housed in the battery case; wherein the housing includes a housing body and a housing cover, the housing body defines an opening at a side for installing the battery case, the battery and the circuit board into the housing body, the housing cover covers the opening of the housing body;

the engagement part includes a rail-shaped portion, and the rail-shaped portion is configured to guide the battery case when the battery case is inserted into the housing body from the opening of the housing body.

7. A theft tracking device comprising:

a circuit board that specifies a current position and transmits current position information regarding the current position specified through a wireless communication;

a battery that supplies electric power to the circuit board;

a battery case that houses at least a part of the battery;

a housing that houses the circuit board, the battery case and the battery housed in the battery case; and an engagement part that is provided by the housing, wherein the engagement part engages with an engagement portion of the battery case, and separates a first space of the housing in which the circuit board is located from a second space of the housing that faces the battery housed in the battery case; wherein the housing includes a housing body and a housing cover, the housing body defines an opening at a side for installing the battery case, the battery and the circuit board into the housing body, the housing cover covers the opening of the housing body; and a portion of the engagement part is provided by the housing cover.

* * * * *